US005400555A

United States Patent [19]

Kantor

[11] Patent Number: 5,400,555

[45] Date of Patent: Mar. 28, 1995

[54] MODULAR SWIMMING POOL WITH WALL HANGING ASSEMBLY

[75] Inventor: Paul Kantor, South Haven, Mich.

[73] Assignee: Polynesian Pools, Ltd. of West Michigan, Holland, Mich.

[21] Appl. No.: 26,859

[22] Filed: Mar. 5, 1993

[51] Int. Cl.[6] ..... E04H 4/04

[52] U.S. Cl. ..... 52/169.7; 52/582.1; 52/365; 52/772; 52/584.1; 52/712; 52/483.1; 256/24; 256/65; 256/67

[58] Field of Search ..... 52/169.7, 169.8, 578, 52/582, 772, 633, 721, 365, 702, 712, 483, 584, 483.1, 582.1, 584.1; 256/24, 65, 67; 4/488, 506; 403/384, 336

[56] References Cited

U.S. PATENT DOCUMENTS

| | | | |
|---|---|---|---|
| 2,488,708 | 11/1949 | Clemetsen | 4/510 |
| 3,015,191 | 1/1962 | Lucchesi . | |
| 3,020,560 | 2/1962 | Bedick | 52/169.7 |
| 3,064,273 | 11/1962 | Kwake . | |
| 3,094,709 | 6/1963 | Miccio et al. . | |
| 3,123,185 | 3/1964 | Van Der Rijst | 52/633 |
| 3,440,780 | 4/1969 | Adam et al. . | |
| 3,750,197 | 8/1973 | Weir . | |
| 3,798,857 | 3/1974 | Barrera | 52/169.8 |
| 3,820,174 | 6/1974 | Rozanski | 52/169.7 |
| 4,124,907 | 11/1978 | Laven | 4/506 X |
| 4,577,449 | 3/1986 | Celli | 52/721 |
| 5,277,004 | 1/1994 | Frei | 52/506 X |

FOREIGN PATENT DOCUMENTS

| | | | |
|---|---|---|---|
| 0895458 | 5/1962 | Canada | 52/633 |
| 1307721 | 9/1962 | France | 52/633 |
| 1319772 | 1/1963 | France | 52/633 |
| 0100687 | 2/1962 | Netherlands | 52/633 |

OTHER PUBLICATIONS

"Revitalize" brochure, published Feb. 1993 by Paul Kantor.

"Have You Thought About it?" brochure, published Dec. 1992 by Paul Kantor.

Middie-Garden Swimming Pool Construction Guide, published Jul. 1992 by William P. Kantor.

*Primary Examiner*—Carl D. Friedman
*Assistant Examiner*—Robert J. Canfield
*Attorney, Agent, or Firm*—Price, Heneveld, Cooper, DeWitt & Litton

[57] ABSTRACT

A hanger plate for interconnecting an upper segmented wall of a swimming pool to a vertical support. The swimming pool includes a floor and a plurality of walls formed by an excavation in the earth. A plurality of wall panels are interconnected end-to-end and located about the top of the excavation. Adjacent each joint of the segmented wall is one vertical support. Each vertical support is located to the exterior of the excavation and secured in the earth. A hanger plate having at least two rows of holes interconnects the vertical support and segmented wall. A first row of holes are elongated in a first direction while the second row of holes are elongated in a direction at a right angle to the first. The elongated holes provide for adjustments vertically and horizontally. The segmented wall is capped by an extruded coping which retains the upper edge of a vinyl liner fitted to the walls and floor of the pool.

19 Claims, 2 Drawing Sheets

MODULAR SWIMMING POOL WITH WALL HANGING ASSEMBLY

FIELD OF THE INVENTION

This invention relates to swimming pools, and particularly to modular or prebuilt swimming pools which are located either on the ground or partially in the ground.

DESCRIPTION OF THE RELATED ART

Traditionally, swimming pools were classified into two groups: on-ground pools and in-ground pools. On-ground pools typically include a light to moderately heavy gauge metal wall supported externally by a plurality of braces. The upper edge of the metal wall is fitted with a coping which retains an upper edge of a vinyl liner used to contain the water. It is not uncommon for the upper edge of the pool to be enclosed or surrounded by a deck to provide access and a lounging area for the bathers. In-ground pools are typically built in an excavation made in the earth. In one example, the walls and floor of the pool are made from poured concrete or similar material. Concrete forms are used to form the sidewalls of the pool. In an alternative, modular walls have been created which are joined together and supported by angular braces which are then covered by concrete. In both cases, excavations are required to locate or form the pool walls. The excavation behind the walls is generally backfilled with earth up to the coping of the pool wall. The modular in-ground pools typically retain a vinyl liner which is used to retain the water within the pool in a fashion similar to on-ground pools.

Disadvantages of on-ground pools include the large and often unattractive shell or wall structure extending above the ground. In addition, angular, often large, braces extend from the exterior of the pool shell into the yard, interfering with the use of the yard about the pool. In-ground pools are expensive to build since they require deep excavations, poured or modular in-ground walls, and backfilling of the earth around the pool structure.

SUMMARY OF THE INVENTION

In a first embodiment, this invention includes a swimming pool having a liner having an upper edge and a plurality of wall panels interconnected to each other to define a segmented upper portion of the walls for supporting the upper edge of the liner. A vertical support is located adjacent a joint between two wall panels and on a side of the panels opposite the liner. A hanger plate is disposed in the joint between each of the interconnected wall panels for adjustably positioning the interconnected wall panels with respect to each other.

According to another aspect of the invention, the hanger or mounting plate used to interconnect the wall panels to the vertical supports provides both vertical and horizontal adjustments of the interconnected walls as well as to provide adjustments in plumb with respect to the gravitational vertical. The mounting plate includes a steel or otherwise rigid sheet having a first set of aligned elongated holes for securing the plate to the vertical support. A second set of aligned holes, generally parallel to the first set and elongated in a direction at a right angle to the first set, provide securement of the mounting plate between adjacent wall panels.

Advantages provided by this invention include the elimination of such construction factors as uneven terrain, underground obstacles and expensive concrete footings. Further advantages include cost savings resulting from shallower excavations and no required backfilling. The straightforward and simple construction sequence makes it ideally suited to the do-it-yourself homeowner.

BRIEF DESCRIPTION OF THE DRAWING FIGURES

A better understanding of the benefits and advantages of the invention may be obtained from the appended detailed description and drawing figures, wherein.

DETAILED DESCRIPTION OF THE PREFERRED EMBODIMENTS

Figure 1:
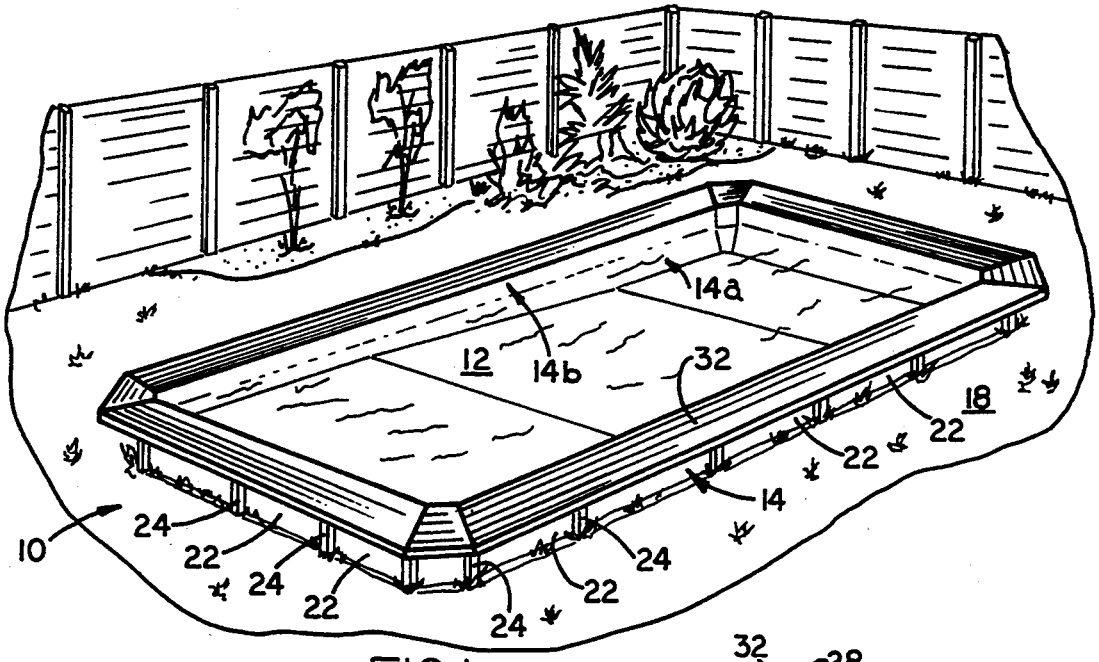
FIG. 1 is an oblique view of a pool embodying the instant invention.
Figure 2:
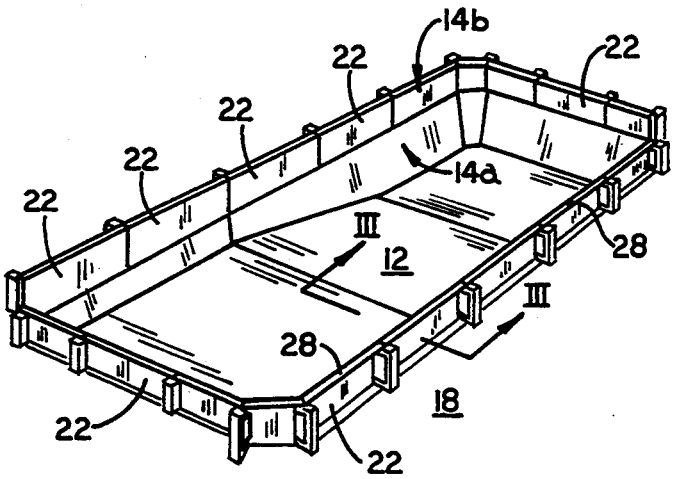
FIG. 2 is an oblique view of the pool in an intermediate stage of construction.
Figure 3:
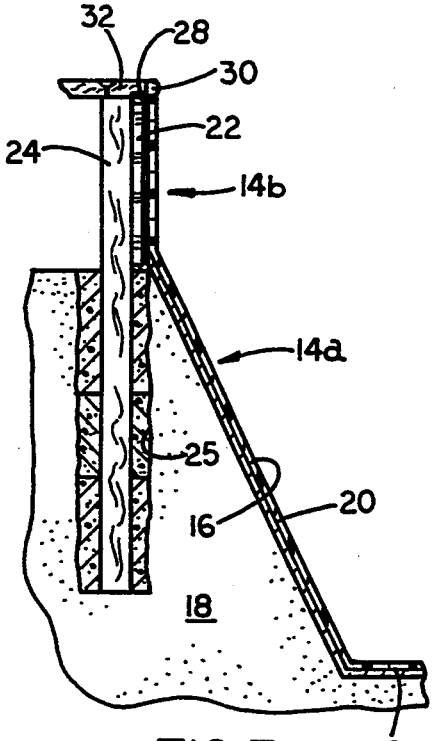
FIG. 3 is a fragmentary section view of the pool shown in FIG. 1 taken along line III—III.
Figure 4:
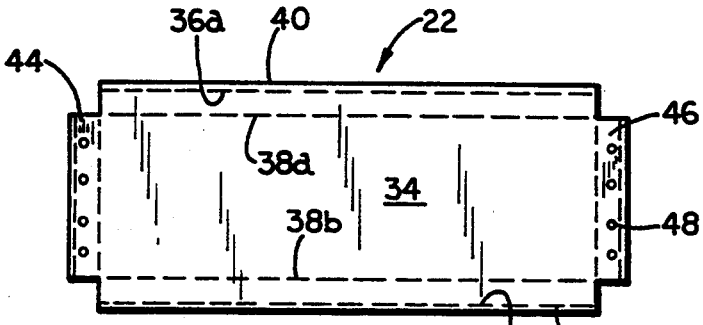
FIG. 4 illustrates a blank used to form a wall panel used in the instant invention.
Figure 5:
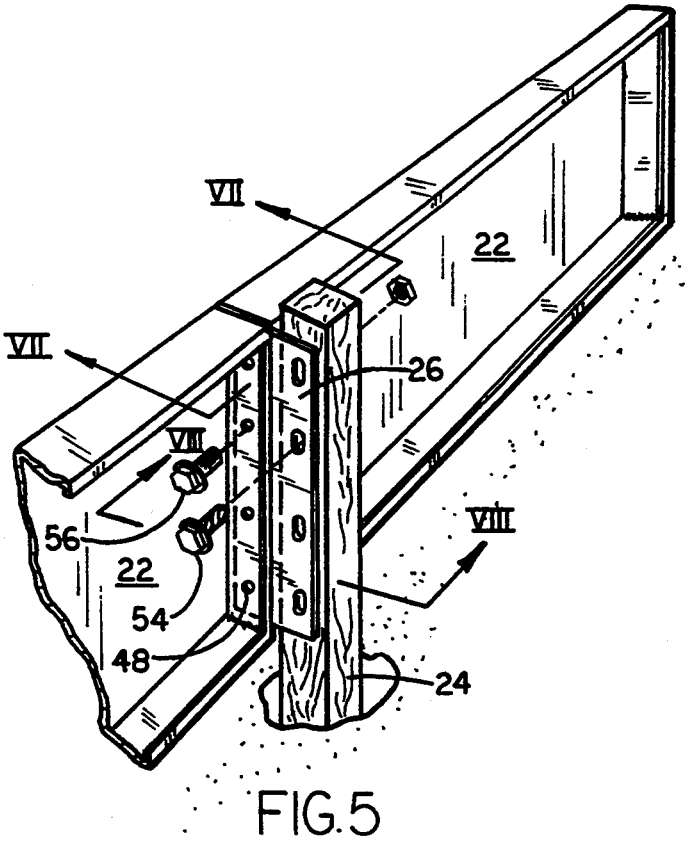
FIG. 5 is an oblique view of an exterior portion of the segmented wall.

Referring now to the drawing figures, pool 10 includes a bottom 12 surrounded by a plurality of walls 14. The bottom 12 and a substantial portion of each wall 14 are formed by an excavation 16 in the ground 18. The portions **14*a* of pool wall 14 formed by the excavation are preferably sloped at an angle less than 75 degrees for reasons which will be apparent below. The walls and floor of excavation 16 are covered by a relatively thin base material 20 such as a Portland cement and vermiculite mixture, to provide a substantially smooth and even surface. The upper portion 14*b* of each wall 14 is defined by a plurality of panels resting along the edge of excavation 16 and interconnected end-to-end by fasteners. The plurality of wall panels 22, forming the segmented upper portion 14*b*, are supported and retained in place by a plurality of posts 24 secured in holes 25 and attached by a hanger plate 26 described in greater detail below. The top edge 28 of wall panels 22 are capped by a coping 30 which is securely fixed to edge 28 and provides a transition to a wooden cap or deck 32 constructed about the top of pool 10. Coping 30**, often made from extruded aluminum, contains a channel for retaining the upper edge of a vinyl liner suspended in the pool interior to contain the water.

Referring to FIGS. 4–8, each panel 22 of the segmented wall is preferably made from a blank 34 of 16-gauge galvanized steel although they also may be formed from fiberglass or plastic. The panel sizes may vary, depending upon the height of wall **14*b* and the dimensions of the pool. It is preferred that each panel be twenty inches tall and have several different lengths such as two, four and six feet. The corner panels are preferred to be seventeen inches long and twenty inches tall. Panels made from galvanized steel blanks are bent into a box configuration to add rigidity and improve the structural stability of the panel. For example, referring to FIG. 4, tabs 40 and 42 of blank 34 may be bent or folded ninety degrees along fold lines 36***a*, 36*b*. A second ninety-degree bend or fold may be made in tabs 40, 42 along fold lines 38*a*, 38*b*. End tabs 44 and 46 may be folded to the same side of panel 22 along fold lines 46*a*, 46*b* to complete the box. Tabs 44 and 46 may be held in place by welding tabs 44 and 46 to tabs 40 and 42.

Figure 6:
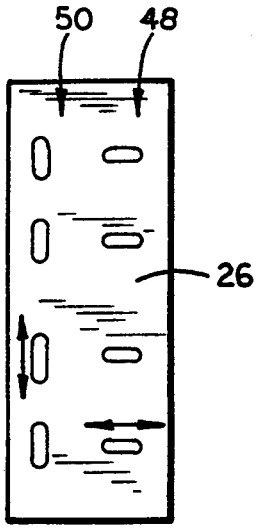
FIG. 6 is a elevation view of a hanger plate.
Figure 7:
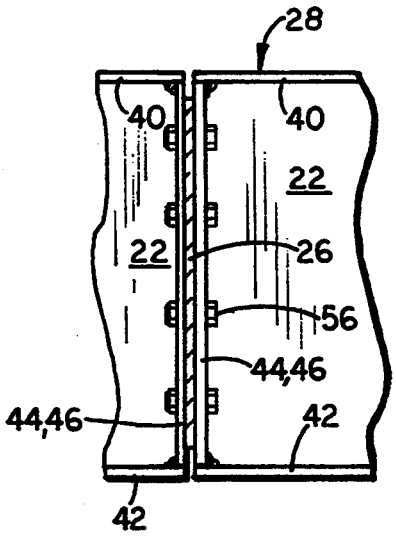
FIG. 7 is a fragmentary elevation view of the segmented wall taken along line VII—VII in FIG. 5.

Referring to FIGS. 5–8, wall panels 22 are joined end-to-end and suspended from posts 24 through hanger plates 26. As shown in FIG. 6, each hanger plate 26 comprises a sheet or plate of rigid material such as steel having two generally parallel rows of holes 48, 50. Preferably, holes 48 are elongated at a right angle to holes 50. For example, each hole 48 is elongated up and down or vertically while holes 50 are elongated from side to side or orthogonally to holes 48. Lag bolts 54 are inserted through holes 50 and threaded in post 24 to attach hanger plate 26 to post 24. The opposite edge of hanger plate 24 is located between adjoining ends of wall panels 22 and fastened in place by fasteners 56 extending through panel end tabs 40, 42 and holes 48. See FIGS. 7 and 8. The orthogonal elongation of holes 48, 50 allow both horizontal and vertical adjustment of the upper portion of wall 14 with respect to each post 24. In a similar fashion, the elongated holes 48, 50 allow minor rotation of the interconnected wall panels to provide for plumb adjustments with respect to the gravitational vertical. Because the digging of post holes 25 are not always accurate, nor are the final locations of vertical supports 24, hanger or mounting plates 26 offer the ability to make such alignment, and plumb adjustments for wall 14*b*.

Figure 8:
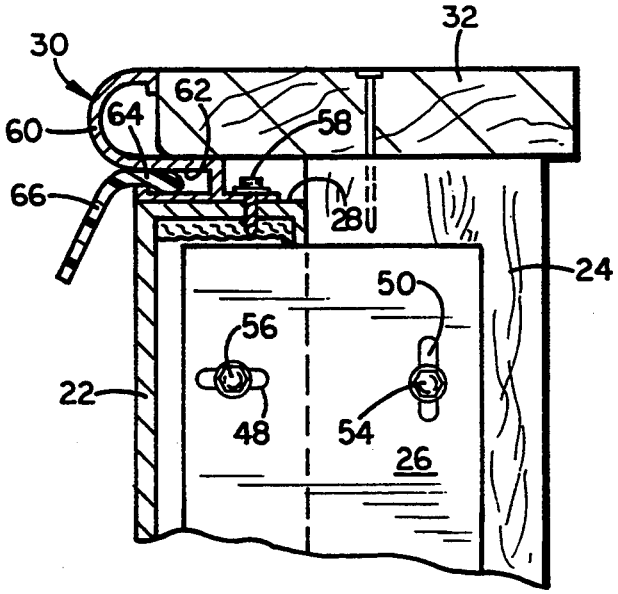
FIG. 8 is a fragmentary section view of the segmented wall taken along line VIII—VIII in FIG. 1.

Referring to FIG. 8, wall panels 22 are capped by an extruded aluminum coping 30 secured to the upper edge 28 by bolts 58. The extruded coping includes a rounded or bull-nosed portion 60 to finish the interior edge of pool 10 while also providing a transition to the wooden cap 32 fastened to the top of posts 24. The coping 30 also includes a channel 62 for receiving and retaining a bead 64 formed along the upper edge of the vinyl liner 66 which drapes within the pool interior to retain the water. To provide a smooth surface in the vinyl liner, joints between the panels are covered by a fabric tape before placing the vinyl liner in the pool. The liner is smoothed in a conventional fashion, as well as receiving the plumbing fitting.

To provide working space when the pool walls are set in place, all outer dimensions of the excavation are 12 inches larger than the actual pool size. For example, the layout for a 16 foot by 32 foot pool is 18 feet by 34 feet. The inside dimensions are the "excavation dimensions." The "overdig" is an extra 12 inch excavation around the perimeter.

The excavation is outlined by four pins, one in each corner. The pins are preferably three-eighths inch by two feet long steel rebar rods. The first layout pin is driven into the ground in the excavation corner that has the highest elevation. From this pin as a working point, the rest of the excavation is layed out on the ground. Care should be taken when laying out the pool. Placement should be proper as it relates to the house, fence-line, or other visual barriers.

The next preferred step is to choose a finished elevation for the pool. The finished elevation is the total height of the pool including any deck. The upper portion 14*b* of wall 14 is designed to sit directly on top of the ground, but can be lowered a few inches if necessary to accommodate a sloping yard. An additional excavation may be necessary outside of the pool area to maintain a good drainage of rainwater away from the pool.

When a finished elevation for the top of the pool has been chosen, this elevation should be noted for future reference. This can be done by marking it on a stake driven into the ground. A predetermined distance above the final elevation is measured to find the "ledge elevation." In a preferred embodiment, the height of the wall 14*b* plus the coping height is 22 and ¼ inches. This distance should be added to the final elevation to mark the ledge elevation.

Once any sod has been stripped and the excavation has been leveled to the ledge elevation, the finished dimensions of the pool are layed out as described above. This will determine the final location of the pool. Fine tune the excavation with a shovel just outside the outline of the pool to indicate where wall panels 22 will rest once bolted together and leveled.

The next step is to locate and dig the holes for the posts, preferably using a power posthole digger with an auger attachment. Note that the post holes are offset from the panel joint by a few inches. Double-check all panel joint locations before digging.

Digging of the pool floor may proceed from either end of the pool, depending on which is more convenient. For example, the depth of the deep end is 54 inches below the level of the ledge elevation. The excavation should proceed down one side of the deep end floor toward the shallow end in the same manner as the deep end walls. Layout and excavate the shallow end walls in the same manner as the deep end. Be careful not to dig into the areas outside of the pool dimensions. Digging so may cave in the post holes and will also remove the supporting ledge for the panels.

After the excavation is complete, the next step is to assemble wall panels 22 and set posts 24. First, the skimmer and return locations must be determined. It is best to place the skimmer under the center of one of the long sides and downwind of the generally prevailing breezes. In this way, the wind will help direct surface dirt and debris to the skimmer for removal from the pool. In addition, thoughtful consideration should be given to the circulation pattern of the wall when placing inlets. Try to eliminate as much as possible all dead spots in the corners. Water temperatures in the heated pool will be kept uniform, chemistry will be constant, and maintenance will be kept to a minimum.

The upper portion 14*b* of wall 14 is assembled by interconnecting 22 together end-to-end with a hanger plate 26 between the panels. Hanger plate 26 is preferably positioned with the bolts in the middle of slotted holes 48, 50. This will allow for adjustment later in the construction if necessary. Wall panels 22 are bolted together so the inside face and top 28 of panel 22 are flush. Proceed to the next panel and repeat the procedure. Assemble the pool and align panels 22 with the pool layout on the ledge. After all the panels are bolted into place, square the pool walls and set the corner posts first.

Once pool wall 14*b* has been squared by checking the length and width and diagonals, level pool wall 14*b* to the final elevation (remember to add the height of the coping) by shimming under wall panels 22 if necessary. Set each post using a concrete or suitable mix. Hanger plates 26 are bolted to posts 24 using lag screws.

Prior to pouring the pool floor, the main drain should be installed. The main drain could be of any one of a number of constructions which are consistent with vinyl-lined pools. Similarly, the skimmer and inlet fittings should be installed following manufacturer's instructions. Any one of a number of skimmers and inlets may be used. Many different types of plumbing can also be used, such as PVC Schedule 40 and PVC pressure slip fitting; polypipe and polyfittings with stainless steel clamps; or even flexible PVC pipe (spa flex pipe is usually available from a swimming pool supply house). It is recommended to use rigid PVC for all plumbing at the equipment pad (not shown).

Once posts 24 are set and panels 22 are leveled, check the depth in various sections of the pool bottom in relation to the top of the wall 14*b*, including the coping. The pool floor should be close to the exact depth and only a small amount of hand trimming will be necessary.

Coping 30 provides a dual purpose. Coping 30 acts as a receptacle (liner channel) for retaining the liner bead and serving as an attractive edging against which decking may be installed. The liner receptacle or channel on the lower edge of the coping should be flush with the top inside edge of pool wall 14*b*. When cutting the pieces of coping and fitting them in place to the top 28 of the wall 14*b*, avoid cutting joints that correspond to the pool wall joints.

Bottom finishing can be done in a conventional manner by progressing from either end of the pool. The vinyl liner is similarly installed in a well-known manner after the joints between the wall panels have been sealed. The pool may be filled and otherwise readied for use.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

The embodiments of the invention in which an exclusive property or privilege is claimed are defined as follows:

1. A swimming pool, comprising:

a liner having an upper edge;

a plurality of panels interconnected to each other to define a segmented upper portion of a wall for supporting said upper edge of said liner;

a plurality of vertical supports, each adjacent a joint between two of said plurality of panels and on a side of said panels opposite said liner; and a plurality of hanger plates, each interconnecting two of said panels to one of said vertical supports, and said plates being provided with adjustment means being adjustable with respect to said panels and said vertical supports for plumb, height and width.

2. The swimming pool as defined in claim 1, wherein each of said plurality of panels include:

a blank of sheet material having a plurality of tabs folded to form a box, said box having a first and second end containing a plurality of holes for receiving fasteners used to interconnect adjacent panels.

3. The swimming pool as defined in claim 2, wherein each of said plurality of supports includes a post having a first end secured to a fixed surface to an exterior of the swimming pool, and a second end terminating proximate an upper edge of said plurality of panels.

4. The swimming pool as defined in claim 3, wherein each of said hanger plates comprises a rigid sheet material, said sheet material provided with said adjustment means, said adjustment means comprising at least two rows of holes, a first row of said holes elongate in a first direction and a second row of holes elongate in a direction at a right angle to the elongation of said first row of holes, each of said first row of holes receiving a fastener for attaching each said hanger plate to each said post, and each of said second row of holes receiving at least one fastener for interconnecting two of said panels.

5. The swimming pool as defined in claim 4, further including said plurality of panels having a lower edge resting along an upper edge of an excavation occupied by a substantial portion of said swimming pool.

6. The swimming pool as defined in claim 5, further including a base coat lining said excavation to provide a substantially smooth floor and lower portion of said wall.

7. The swimming pool as defined in claim 6 wherein each of said plurality of supports secured to a fixed surface includes a first end anchored in a post hole formed in the earth adjacent said excavation.

8. An apparatus for providing adjustable support for a segmented pool wall, comprising:

a vertical support having one end adapted to be securely fixed in relation to the segmented wall; and a hanger plate connected to said vertical support for interconnecting the segmented wall to said vertical support, said hanger plate provided with adjustment means for providing plumb, height and width adjustments of the segmented wall relative to said vertical support.

9. The apparatus as defined in claim 8, wherein said vertical support further comprises a post having a first end anchored in the earth.

10. The apparatus as defined in claim 9, wherein said hanger plate provided with avid adjustment means comprises a rigid sheet material having a first row of holes elongate in a first direction and a second row of holes parallel to said first row and elongate in a direction orthogonal to said first direction, said first row of holes receiving a plurality of fasteners for attaching said hanger plate to said post,, and said second row of holes for receiving a plurality of fasteners interconnecting said segmented wall, the elongation of said first and second rows of holes adapted to allow plumb, height and width adjustment of said segmented wall relative to said post.

11. The apparatus as defined in claim 10, wherein said hanger plate includes a sheet of steel having a longitudinal axis generally parallel to said first and second rows of holes.

12. The apparatus as defined in claim 11, wherein said first and second row of holes are elongate in a plane containing said sheet of steel.

13. A swimming pool, comprising:

a plurality of panels interconnected to each other to define a segmented wall, each of said panels formed from a blank of sheet material having at least one tab defined on at least two opposite edges of said blank, each tab containing a plurality of holes for receiving fasteners used to interconnect adjacent ones of said panels;

a plurality of vertical supports, each adjacent a joint between two of said plurality of panels; and a plurality of hanger plates, each interconnecting two of said plurality of panels to one of said vertical supports, said plates provided with adjustment means for providing plumb height and width adjustment of said panels with respect to said vertical supports.

14. The swimming pool as defined in claim 13, wherein each of said plurality of vertical supports includes a post having a first end secured to a fixed surface to an exterior of the swimming pool, and a second end terminating proximate an upper edge of said plurality of panels.

15. The swimming pool as defined in claim 14, wherein each of said hanger plates comprises a rigid sheet material provided with said adjustment means, said adjustment means comprising at least two rows of holes, a first row of said holes elongate in a first direction and a second row of holes elongate in a direction at a right angle to the elongation of said first row of holes, said first row of holes receiving a fastener for attaching each said hanger plate to each said post, and said second row of holes receiving a fastener for interconnecting two of said panels.

16. The swimming pool as defined in claim 15, further including said plurality of panels having a lower edge resting along an upper edge of an excavation defining a lower portion of said swimming pool.

17. The swimming pool as defined in claim 16, further including a base coat lining said excavation to provide a substantially smooth floor and lower portion of said wall.

18. The swimming pool as defined in claim 17 wherein each of said plurality of vertical supports secured to a fixed surface includes a first end anchored in a post hole formed in the earth adjacent said excavation.

19. The apparatus as defined in claim 15, wherein said hanger plate includes:

a sheet of steel having a longitudinal axis generally parallel to said first and second rows of holes; and said first and second rows of holes are elongate in a plane containing said sheet of steel.

* * * * *

UNITED STATES PATENT AND TRADEMARK OFFICE

CERTIFICATE OF CORRECTION

PATENT NO. : 5,400,555
DATED : March 28, 1995
INVENTOR(S) : Kantor

It is certified that error appears in the above-identified patent and that said Letters Patent is hereby corrected as shown below:

Col. 5, line 53, after "supports," delete –and–;

Col. 6, line 38, "avid" should be –said–; and

Col. 6, line 44, "post,," should be –post,–.

Signed and Sealed this

Thirteenth Day of May, 1997

*Attest:*

*Attesting Officer*

BRUCE LEHMAN

*Commissioner of Patents and Trademarks*